United States Patent [19]

Luntamo

[11] Patent Number: 4,999,085

[45] Date of Patent: Mar. 12, 1991

[54] METHOD FOR SCREENING OF DEFIBERED CHLORINE DIOXIDE BLEACHED PULP DURING ALKALINE EXTRACTION

[75] Inventor: Juhani Luntamo, Pori, Finland

[73] Assignee: Sunds Defibrator Rauma Oy, Pori, Finland

[21] Appl. No.: 252,938

[22] Filed: Oct. 4, 1988

[51] Int. Cl.[5] ..... D21C 9/14; D21D 5/02

[52] U.S. Cl. ..... 162/40; 162/55; 162/89

[58] Field of Search ..... 162/55, 60, 89, 40

[56] References Cited

U.S. PATENT DOCUMENTS

| | | | |
|---|---|---|---|
| 4,220,498 | 9/1980 | Prough | 162/55 |
| 4,274,913 | 6/1981 | Kikuiri et al. | 162/60 |
| 4,529,479 | 7/1985 | Tuomi | 162/89 |

*Primary Examiner*—Steve Alvo

*Attorney, Agent, or Firm*—Burns, Doane Swecker & Mathis

[57] ABSTRACT

A method for the screening of defibred pulp bleached in several steps. In the method, the pulp coming from an acidic bleaching step (2) is screened (3, 4, 5, 6) at the same time as it is treated with an alkali. In this way, no separate alkali stage is needed.

19 Claims, 1 Drawing Sheet

METHOD FOR SCREENING OF DEFIBERED CHLORINE DIOXIDE BLEACHED PULP DURING ALKALINE EXTRACTION

The invention concerns a screening method for defibred pulp to be bleached in several steps.

As a rule, fibrous pulp must be screened in order that fibre knots, sand, etc. impurities could be removed from it. Bleached pulp is usually screened in two steps, so that coarse screening is first carried out by means of pressurized screens at a consistency of about 1 . . . 3%, and then finer screening is carried out by means of vortex cleaners at a consistency of about 0.5 . . . 1%.

Pulp is usually bleached in several steps, each step having a chemical blender, reactor, and washer of its own. The number of the bleaching steps and the conditions in each step vary from plant to plant. For sulphate pulp, a typical bleaching sequence is, e.g., chlorine/-chlorine-dioxide, alkali, chlorine dioxide, alkali, chlorine dioxide (C/DEDED).

At present, bleached pulp is usually screened after the last bleaching step. Thereat, the pulp is placed in intermediate storage in a high-consistency pulp storage tower, out of which it is passed through a diluting tank into the screening plant and further to final thickening.

In a more recent solution, the screening plant is placed immediately after the last bleaching tower before washing. In such a case, the washer must be provided with a pre-thickener if the consistency of the pulp coming from screening is lower than 1%, which is usually the case. As compared with the conventional solution, in this way, however, one thickener with its pipings and other auxiliary equipment can be omitted in the process.

The main object of the present invention is to provide a screening method which is simpler than the prior-art solutions.

In the method now invented, the pulp coming from the acidic bleaching stage is, before washing, subjected to screening under alkaline conditions, whereby no separate alkali step is needed. In such a case, the screening conditions (pH, temperature, time of stay, consistency) must, of course, be chosen so that the desired alkali treatment can be accomplished.

The screening is preferably carried out at a lower consistency than the bleaching stage, whereby the pulp is diluted in the first stage of screening. The necessary alkali is supplied preferably into the diluting water. When a conventional bleaching tower is used, the diluting water can be used at the same time for removing the pulp out of the tower.

The screening can also be run at the consistency used in the bleaching tower, e.g., as so-called MC screening at a consistency of 8 . . . 18%, in which case diluting is not required.

After screening, the pulp must usually be thickened, whereat it is preferably washed at the same time. Before washing, it is also possible to carry out pre-thickening if necessary. The filtrate obtained from washing can be used favourably for the dilution for the screening stage.

When a screening unit in accordance with the invention is used, which operates under alkaline conditions and is placed immediately after the bleaching step, no separate alkali step is required. This provides significant economies in investments.

DETAILED DESCRIPTION

Figure 1:
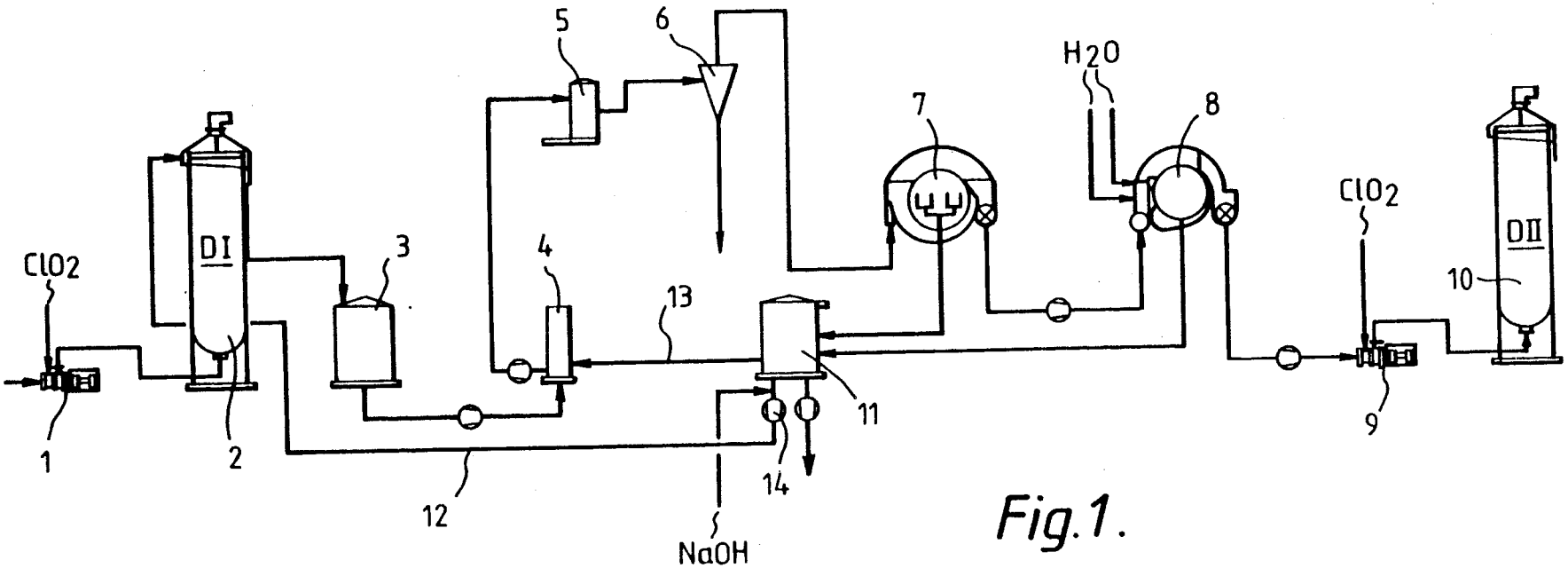
FIG. 1 is a schematical illustration of the last three stages in a multi-step bleaching process.

An embodiment and advantages of the invention will still be described in detail in the following. The description is related to FIG. 1.

FIG. 1 illustrates a multi-step bleaching process, wherein the last steps are treatments with chlorine dioxide, alkali extraction, and chlorine dioxide (DI, EII, DII). In step DI, chlorine dioxide is introduced into the pulp flow by means of a chemical blender 1, and the pulp is passed into the bleaching tower 2. In the tower, the pH of the pulp is about 3.5, the temperature about 70° C., and the stay about 180 . . . 240 min. The reaction conditions have a rather wide range of variation depending on the quality of the pulp and on the desired final consistency.

From the bleaching tower 2 the pulp is passed through diluting tanks 3 and 4 to screening, where it is treated first by means of a pressurized screen 5 and then by means of a vortex cleaner 6. Both the pressurized screening and the vortex cleaning are multi-stage processes, but here each process is illustrated by means of one apparatus only. The pressurized screening is carried out at a consistency of about 1 . . . 3% and the vortex cleaning at a consistency of about 0.5 . . . 1%. After screening, the pulp is passed through a pre-thickener 7 and a washer 8 to step DII, which includes a chlorine-dioxide blender 9 and a reactor tower 10.

The filtrates coming from the thickener 7 and from the washer 8 are passed to the filtrate tank 11. The filtrate is used as the diluting water after step DI. Any excess filtrate is let off or used in other bleaching steps. Part of the filtrate is passed out of the tank 11 as a flow 12 to the discharge of the tower 2. Part of it is again passed as a flow 13 to the diluting tank 4. The water coming to the washer 8 may be clean water or filtrate coming from some other stage.

Before the pump 14, such an amount of sodium hydroxide is added to the discharge water flow 12 that the pH of the pulp after the diluting tank 4 becomes adjusted to the desired level.

Thus, in the process described herein, the pulp is screened at the same time as it is subjected to the alkali treatment. By means of this solution, in particular the following advantages are obtained:

no separate thickener is needed after screening, no separate alkali step with its equipment needed, economies of about 20 per cent are obtained in respect of the building volume of the bleaching plant, the time of stay required for alkali treatment is achieved more readily than in an alkali treatment taking place by means of a two-stage washer alone, the corrosion conditions in the screening plant are easier to handle than after the 2nd dioxide stage, wherein the conditions are acidic and chloride-containing, in the last bleaching step, the conditions can be made more gentle, because the pulp is already of uniform quality and clean.

What is claimed is:

1. Method for the screening of defibered pulp in a process wherein defibered defibred pulp is bleached by means of a multi-stage bleaching sequence which includes at least one chlorine dioxide bleaching stage carried out under acidic conditions and a subsequent alkali extraction treatment, comprising:

screening the pulp coming from the acidic chlorine dioxide bleaching stage at the same time as it is extracted with an alkali(14), and further bleaching the screened and extracted pulp in a second bleaching stage, wherein the screening removes fiber knots and impurities from the pulp.

2. Method as claimed in claim 1, wherein in a first stage of screening, the pulp that comes from the acidic bleaching step (2) is diluted (3, 4).

3. Method as claimed in claim 2, wherein after the screening the pulp is washed (8).

4. Method as claimed in claim 1, wherein after the screening the pulp is washed (8).

5. Method as claimed in claim 4, wherein the bleaching step is carried out in a bleaching tower, wherein a filtrate (12) received from washing is passed into the bleaching tower so as to remove the pulp from the tower, whereby the pulp is diluted (3) at the same time.

6. Method as claimed in claim 5, wherein part of the filtrate (13) is passed into a pulp diluting tank (4) placed immediately after the bleaching tower to constitute diluent.

7. Method as claimed in claim 1 wherein an alkali is added to the diluent (12).

8. Method as claimed in claim 4 wherein after the screening, and before washing, the pulp is thickened (7).

9. Method as claimed in claim 1, wherein in the first stage of screening, the pulp that comes from the acidic bleaching step (2) is diluted (3,4) after the screening the pulp is washed (8), and a filtrate obtained from washing is used for diluting (12,13) of the pulp that comes from the bleaching step.

10. Method as claimed in claim 1, wherein after the screening the pulp is washed (8), and a filtrate obtained from washing is used for diluting (12,13) of the pulp that comes from the bleaching step.

11. Method as claimed in claim 9, wherein the bleaching step is carried out in a bleaching tower, wherein the filtrate (12) received from washing is passed into the bleaching tower so as to remove the pulp from the tower, whereby the pulp is diluted (3) at the same time.

12. Method as claimed in claim 10, wherein the bleaching step is carried out in a bleaching tower, wherein the filtrate (12) received from washing is passed into the bleaching tower so as to remove the pulp from the tower, whereby the pulp is diluted (3) at the same time.

13. Method as claimed in claim 2, wherein an alkali is added to the diluent (12).

14. Method as claimed in claim 4, wherein alkali is added to the diluent (12).

15. Method as claimed in claim 5, wherein an alakli is added to the diluent (12).

16. Method as claimed in claim 6, wherein an alkali is added to the diluent (12).

17. Method as claimed in claim 9, wherein an alkali is added to the diluent (12).

18. Method as claimed in claim 10, wherein an alakli is added to the diluent (12).

19. Method as claimed in claim 5, wherein part of the filtrate (13) is passed into a pulp diluting tank (4) placed immediately after the bleaching tower to constitute diluent, an alkali is added to the diluent (12), and an alkali is added to the filtrate (12) to be passed into the bleaching tower.

* * * * *